US009559421B2

(12) United States Patent
Nakamura et al.

(10) Patent No.: US 9,559,421 B2
(45) Date of Patent: Jan. 31, 2017

(54) ANTENNA

(75) Inventors: Masaki Nakamura, Tottori (JP); Hiroshi Okamoto, Tottori (JP); Hirohiko Miki, Tottori (JP)

(73) Assignee: HITACHI METALS, LTD., Tokyo (JP)

( * ) Notice: Subject to any disclaimer, the term of this patent is extended or adjusted under 35 U.S.C. 154(b) by 83 days.

(21) Appl. No.: 14/234,224

(22) PCT Filed: Jul. 20, 2012

(86) PCT No.: PCT/JP2012/068484

§ 371 (c)(1),
(2), (4) Date: Jan. 22, 2014

(87) PCT Pub. No.: WO2013/015222

PCT Pub. Date: Jan. 31, 2013

(65) Prior Publication Data

US 2014/0168026 A1 Jun. 19, 2014

(30) Foreign Application Priority Data

Jul. 22, 2011 (JP) ..... 2011-160900
Mar. 30, 2012 (JP) ..... 2012-079300

(51) Int. Cl.
*H01Q 7/00* (2006.01)
*H01F 5/04* (2006.01)
(Continued)

(52) U.S. Cl.
CPC ..... *H01Q 7/00* (2013.01); *H01F 5/04* (2013.01); *H01Q 1/40* (2013.01); *H01Q 7/06* (2013.01)

(58) Field of Classification Search
CPC ..... H01Q 7/00; H01Q 5/04; H01Q 1/40; H01Q 7/06
(Continued)

(56) References Cited

U.S. PATENT DOCUMENTS 6,380,834 B1 * 4/2002 Canzano ..... H01F 27/2804 336/200
6,412,702 B1 * 7/2002 Ishikawa ..... G06K 19/072 235/380
(Continued)

FOREIGN PATENT DOCUMENTS

CN 1619572 A 5/2005
CN 1816945 A 8/2006
(Continued)

OTHER PUBLICATIONS

Communication dated Dec. 3, 2014, issued by the State Intellectual Property Office of the People's Republic of China in corresponding Chinese Application No. 201280036144.1.
(Continued)

*Primary Examiner* — Huedung Mancuso
(74) *Attorney, Agent, or Firm* — Sughrue Mion, PLLC

(57) ABSTRACT

An antenna comprising a coreless coil formed by winding a conductor wire, a relay member connected to the coil, and a magnetic plate member covering the coil and part of the relay member; the relay member comprising a substrate having a notch for lead wires of the coil, and a pair of terminal members formed on the substrate; each terminal member comprising an internal terminal portion connected to an end of each lead wire, an external terminal portion connected to an external circuit, and a line portion connecting the internal terminal portion to the external terminal portion; the coil and part of the relay member disposed on the magnetic member being fixed to a first adhesive layer on the non-transmission side of the coil; and the internal terminal portion being positioned in a region overlapping the magnetic member, or in a region surrounded by the notch of the magnetic member.

10 Claims, 14 Drawing Sheets

(51) Int. Cl.
*H01Q 1/40* (2006.01)
*H01Q 7/06* (2006.01)

(58) Field of Classification Search
USPC ..... 343/788; 336/200
See application file for complete search history.

(56) References Cited

U.S. PATENT DOCUMENTS

| | | | | |
|---|---|---|---|---|
| 7,152,803 | B2 * | 12/2006 | Stromberg | G06K 19/07749 235/488 |
| 7,495,625 | B2 | 2/2009 | Endo et al. | |
| 7,712,672 | B2 | 5/2010 | Takahashi et al. | |
| 8,169,286 | B2 | 5/2012 | Hasegawa et al. | |
| 8,188,826 | B2 * | 5/2012 | Okada | H01F 38/14 336/192 |
| 8,188,933 | B2 | 5/2012 | Nakamura et al. | |
| 8,378,774 | B2 * | 2/2013 | Okada | H01F 27/402 336/179 |
| 2003/0020583 | A1 * | 1/2003 | Hui | H01F 27/365 336/200 |
| 2005/0092836 | A1 | 5/2005 | Kudo | |
| 2005/0162331 | A1 | 7/2005 | Endo et al. | |
| 2005/0270745 | A1 * | 12/2005 | Chen | H01F 27/2804 361/707 |
| 2007/0030659 | A1 * | 2/2007 | Suzuki | H01F 17/0013 361/793 |
| 2007/0095913 | A1 | 5/2007 | Takahashi et al. | |
| 2008/0197960 | A1 | 8/2008 | Hasegawa et al. | |
| 2009/0001930 | A1 * | 1/2009 | Pohjonen | H01Q 1/2225 320/108 |
| 2009/0015197 | A1 * | 1/2009 | Sogabe | H02J 7/0011 320/108 |
| 2010/0156735 | A1 | 6/2010 | Nakamura et al. | |
| 2013/0057375 | A1 * | 3/2013 | Ankyu | B32B 18/00 336/83 |

FOREIGN PATENT DOCUMENTS

| | | | |
|---|---|---|---|
| CN | 101286411 | A | 10/2008 |
| CN | 101345437 | A | 1/2009 |
| CN | 201655982 | U | 11/2010 |
| JP | 2002-373319 | A | 12/2002 |
| JP | 2004-166175 | A | 6/2004 |
| JP | 2006-164083 | A | 6/2006 |
| JP | 2006-174223 | A | 6/2006 |
| JP | 2010-200061 | A | 9/2010 |
| JP | 5024263 | B2 | 9/2012 |
| WO | 2006/036012 | A1 | 4/2006 |

OTHER PUBLICATIONS

International Search Report of PCT/JP2012/068484 dated Oct. 23, 2012.

* cited by examiner

ANTENNA

CROSS REFERENCE TO RELATED APPLICATIONS

This is a National Stage of International Application No. PCT/JP2012/068484 filed Jul. 20, 2012 (claiming priority based on Japanese Patent Application No. 2011-160900 filed Jul. 22, 2011 and Japanese Patent Application No. 2012-079300 filed Mar. 30, 2012), the contents of which are incorporated herein by reference in their entirety.

FIELD OF THE INVENTION

The present invention relates to an antenna used for magnetic-field-inductive, small-power wireless communications, for example, RFID (radio frequency identification) in small wireless communications apparatuses such as mobile phones, particularly to an antenna for near field communications (NFC) using a communication frequency band of 13.56 MHz.

BACKGROUND OF THE INVENTION

IC card systems are widely known as those for near-field wireless communications. FIG. 20 shows one example of the structures of IC card systems (JP 2010-200061 A). Taking data transmission from a read/write apparatus to a transponder for example, the structure and operation of this IC card system will be explained. A reader/writer 280 (hereinafter referred to simply as "antenna apparatus") as an apparatus for reading and writing data comprises a first antenna 1*a* for near-field wireless communications, which radiates electromagnetic waves to form a magnetic field around the antenna apparatus 280. When an IC card 285 as the transponder is made close to the antenna apparatus 280, a second antenna 1*b* for near-field wireless communications in the IC card 285 is magnetically coupled to the first antenna 1*a*, so that power is supplied to an integrated circuit 68 by electromagnetic induction, and data transmission is conducted according to protocol set in advance between the antenna apparatus 280 and the IC card 285 (for example, ISO 14443, 15693, 18092, etc.).

The antenna apparatus 280 comprises a semiconductor 70, a first filter (noise filter) 71, a matching circuit 72, and a second filter 73. The semiconductor 70 comprises a transmission circuit, a receiving circuit, a modulation circuit, a demodulation circuit, a controller, etc. An antenna resonance circuit 66 comprises the first antenna 1*a* for near-field wireless communications, a resonance capacitor 65, and a resistor (not shown). The resonance frequency of the antenna resonance circuit 66 is set to be an intrinsic frequency (for example, 13.56 MHz) used for communications, in which a real part of impedance of the antenna resonance circuit 66 is substantially in a short-circuited state. The antenna resonance circuit 66 is connected to the semiconductor 70 via the impedance-matching circuit 72.

An output terminal Tx connected to the modulation circuit in the transmission circuit in the semiconductor 70 is connected to the impedance-matching circuit 72 via the first filter 71 for EMC. An input terminal Rx connected to the demodulation circuit in the receiving circuit in the semiconductor 70 is connected to a connection point of the first filter 71 and the impedance-matching circuit 72 via the second filter 73 comprising series-connected resistor and capacitor.

The transmission circuit and the receiving circuit in the semiconductor 70 are controlled to be an operation state or a non-operation state by the controller. Signals having a frequency (for example, 13.56 MHz) corresponding to a tuning frequency are supplied from an oscillator to the transmission circuit, the signals being modulated according to a predetermined protocol and supplied to the antenna resonance circuit 66. The first antenna 1*a* for near-field wireless communications in the antenna resonance circuit 66 is magnetically coupled to the second antenna 1*b* for near-field wireless communications in the IC card 285 at a predetermined coupling constant, thereby transmitting signals (carrier signals) to the IC card 285. Signals (carrier signals) from the IC card 285 are received by the receiving circuit in the semiconductor 70, after suppressed by a resistor in the second filter 73.

The antenna for near-field wireless communications (hereinafter referred to simply as "antenna") used in such system comprises, as generally shown in FIG. 21, a coil 10 spirally wound on a surface of a substrate 410. This antenna 1 is called a flat coil, suitable for height reduction. When high-frequency current is supplied to the coil 10, a substantially uniform magnetic flux is generated on the coil side and its opposite side with the substrate 410 as a boundary. However, because only a magnetic flux on the coil side contributes to communications, and because the magnetic flux does not reach far, communication is achieved in a short distance. Hereinafter, a side on which the magnetic flux is used for communications is called "transmission surface side," and a side on which it is not used for communications is called "non-transmission surface side."

In a wireless communications apparatus, a metal shield formed by a metal sheet or case, etc. is usually disposed near the antenna 1. In this case, parasitic capacitance is formed between the coil 10 and the metal shield, so that eddy current is generated in the metal shield, reducing the inductance of the coil 10, and changing the resonance frequency of the antenna 1. Further, eddy current loss is generated, making it necessary to increase electric supply to the coil 10 for compensation, resulting in increased battery consumption. In addition, the magnetic flux not contributing to communications acts as noise to other parts, likely causing troubles.

Against such problems, the attachment of a high-permeability magnetic member to a non-transmission side of an antenna is proposed (JP 2004-166175 A). FIGS. 22(*a*) and 22(*b*) show a reader/writer antenna 1 having such structure. The antenna 1 comprises a magnetic plate member 30 formed on a metal shield 26, and a coil 10 attached to an upper surface of the magnetic plate member 30. Because a magnetic flux 250 generated by the coil 10 passes mainly through the magnetic member 30, the magnetic flux does not spread on the side of the magnetic member 30 (non-transmission surface side), and reaches far on the opposite side of the magnetic member 30 (transmission surface side), thereby having directivity. The magnetic member 30 between the metal shield 26 and the coil 10 prevents the formation of parasitic capacitance, and reduces eddy current generated in the metal shield 26.

The transmission of power and data by electromagnetic induction has long been known. For example, in noncontact-charging antennas, coils formed by enameled wires are fixed to magnetic member surfaces. To handle larger power than in small-power wireless communications (for example, to supply current of about 1 A to the coils), enameled wires of about 1 mm in diameters are generally used, with coil ends not fixed for flexibility.

Antennas for small-power wireless communications constituted according to the structure of the noncontact-charging antennas have been found to suffer the following problems. Because the antennas for small-power wireless communications handle power of at most about 15 mA, conductor wires having as small diameters as 100 μm or less can be used, and the formation of coils is easy. However, when the coil ends are free, thin lead wires are easily deformed by a small external force, restricting connection methods to other circuits. Also, when the antennas are bent or disposed on curved surfaces, tension is applied to the lead wires, likely resulting in the breakage of conductor wires of the coils, and the unwinding of coils.

Though the coils can have thick conductor wires for increased strength, the coils become thick, particularly in portions overlapping the lead wires at their ends. The antennas become thicker as the conductor wires have larger diameters. When used for small wireless communications apparatuses such as mobile phones, thin, small antennas are preferable, so that substrates should have slits for receiving lead wires to prevent the thickness increase of antennas.

In applications of limited thickness such as IC card systems, coils should be as thin as possible to provide easily handleable, thin antennas resistant to breakage, etc. Thus proposed are the formation of a coil called "printed coil" on a flexible substrate by etching a metal foil or a vapor-deposited metal film in place of using a conductor wire such as an enameled wire (JP 2004-166175 A), and the production of an antenna by printing a conductive paste in a coil shape, and transferring the resultant coil-shaped conductor pattern onto an adhesive film. However, the printed coil needs a patterning step, an etching step, etc., and the transfer-printed coil needs a printing step, a transferring step, etc., resulting in more expensive coils than those constituted by conductor wires.

In addition, because the printed coil has a thickness of about 30 μm, it should be wide to have smaller electric resistance to avoid the deterioration of antenna characteristics such as a Q value, etc. Accordingly, with the same number of winding, the printed coil occupies a larger area than that of the conductor wire coil, preventing the miniaturization of antennas. The reduction of the number of winding of a coil for being received in a predetermined size results in inductance decrease and a smaller communication distance. Though the conductor pattern can be made thicker, coils become more expensive accordingly.

OBJECT OF THE INVENTION

Accordingly, an object of the present invention is to provide an antenna, which is less expensive and lower than printed coils, etc., and easily connectable to other circuits, and comprises a conductor wire coil whose lead wires are resistant to breakage.

DISCLOSURE OF THE INVENTION

The antenna of the present invention comprises a coreless coil formed by winding a conductor wire, a relay member connected to the coil, and a magnetic plate member covering the coil and part of the relay member;

the relay member comprising a substrate having a notch, through which lead wires of the coil pass, and a pair of terminal members formed on the substrate, each terminal member comprising an internal terminal portion connected to an end of each lead wire, an external terminal portion connected to an external circuit, and a line portion connecting the internal terminal portion to the external terminal portion;

the coil and part of the relay member disposed on the magnetic member being fixed to a first adhesive layer on the non-transmission side of the coil; and the internal terminal portions being positioned in a region overlapping the magnetic member, or in a region surrounded by a hole or notch of the magnetic member.

In one embodiment of the present invention, the relay member comprises a first region overlapping the magnetic member, and a second region extending from an outer periphery of the magnetic member; and the external terminal portions in the second region are exposed on the transmission surface side of the magnetic member.

In another embodiment of the present invention, the second region of the relay member is bent to the magnetic member side, so that the external terminal portions appear on a non-transmission surface side of the magnetic member.

In a further embodiment of the present invention, both of the coil and the relay member are covered with a second adhesive layer provided on the transmission side of the coil.

In a still further embodiment of the present invention, a protective layer of a resin film is attached to the non-transmission surface side of the magnetic member.

In a still further embodiment of the present invention, the relay member extends to an inner periphery of the coil.

In a still further embodiment of the present invention, the magnetic member is constituted by pluralities of pieces attached to the first adhesive layer for flexibility.

In a still further embodiment of the present invention, pluralities of the pieces are formed by dividing the magnetic member along its slits, through-holes or recesses.

BRIEF DESCRIPTION OF THE DRAWINGS

FIG. 8(*b*) is a cross-sectional view taken along the line A-A in FIG. 8(*a*).

FIG. 15(*b*) is a plan view showing a relay member in the antenna of FIG. 15(*a*).

FIG. 18(*b*) is a perspective view showing the second step of assembling the antenna of the present invention.

FIG. 18(*c*) is a perspective view showing the third step of assembling the antenna of the present invention.

FIG. 18(*d*) is a perspective view showing the fourth step of assembling the antenna of the present invention.

FIG. 22(*b*) is a cross-sectional view showing another example of conventional antennas.

DESCRIPTION OF THE PREFERRED EMBODIMENTS

The embodiments of the present invention will be explained referring to the attached drawings, and it should be noted that explanation concerning an antenna in each embodiment is applicable to antennas in other embodiments unless otherwise mentioned. Particularly, explanations of materials of parts are common in any embodiments.

[1] First Embodiment (1) Structure

Figure 1:
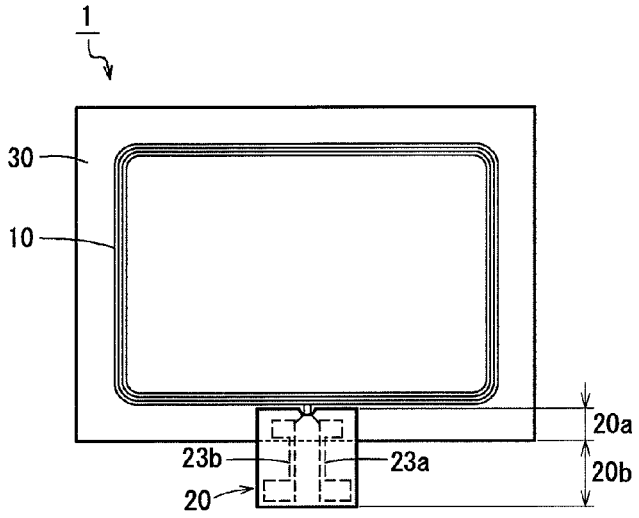
FIG. 1 is a plan view showing an antenna according to the first embodiment of the present invention.
Figure 2:
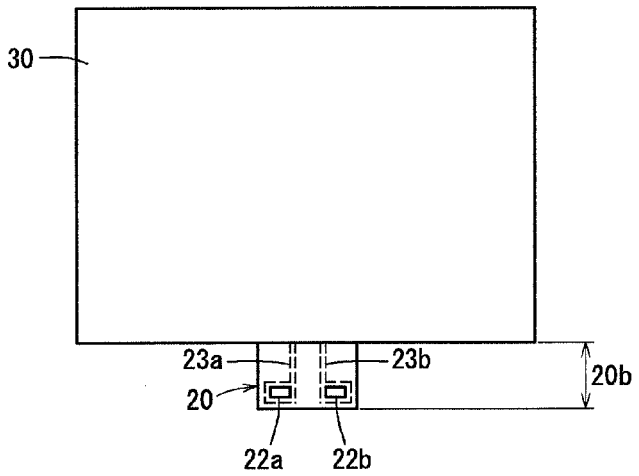
FIG. 2 is a bottom view showing an antenna according to the first embodiment of the present invention.
Figure 3:
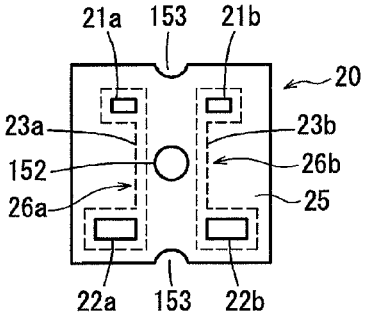
FIG. 3 is a plan view showing a relay member used in the antenna according to the first embodiment of the present invention.
Figure 4:
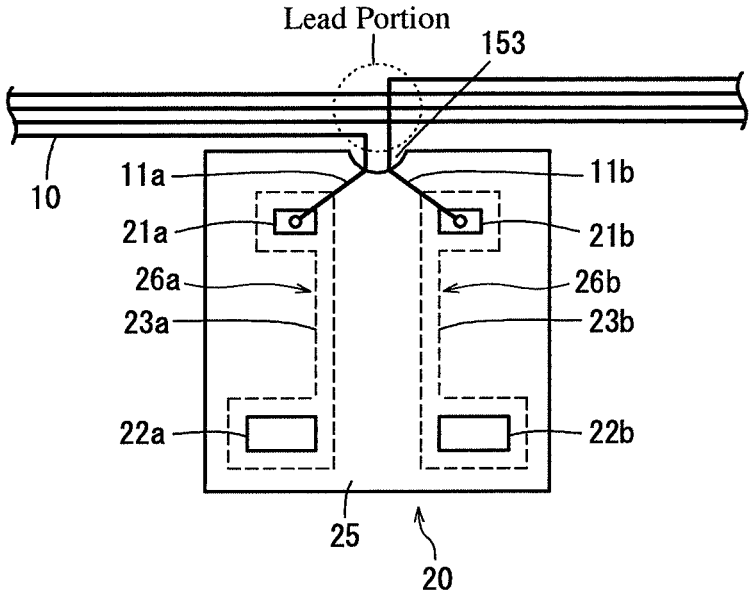
FIG. 4 is a plan view showing the connection structure of a coil to a relay member in the antenna according to the first embodiment of the present invention.
Figure 5:
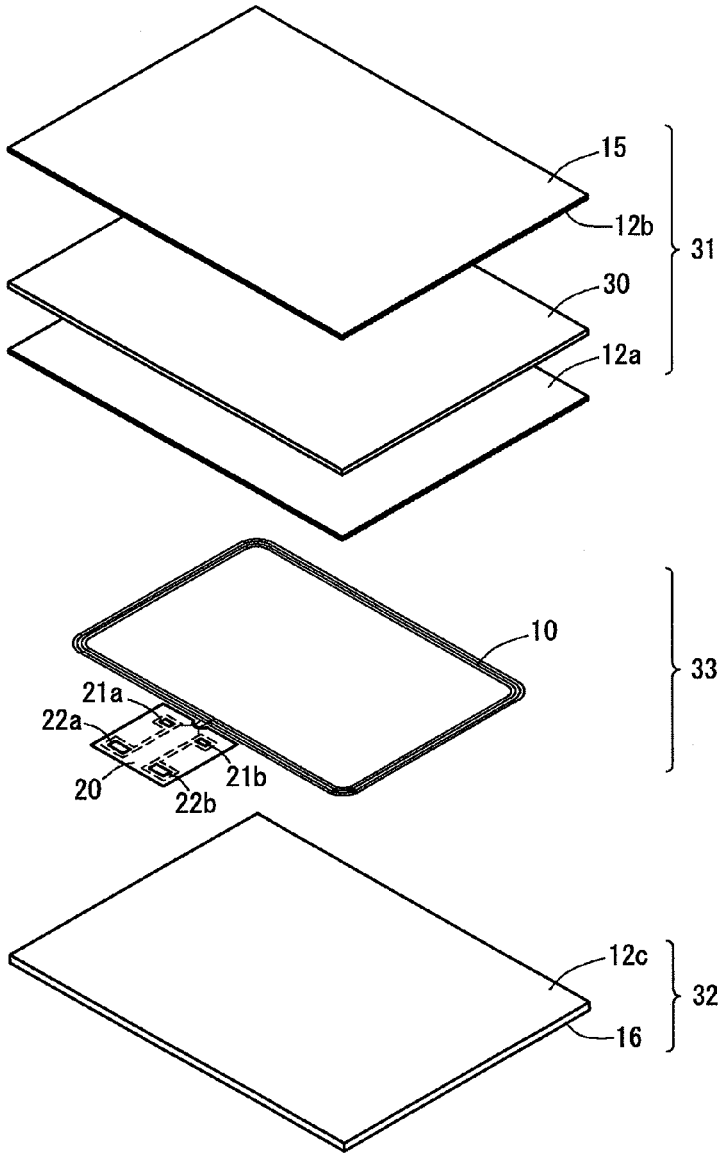
FIG. 5 is an exploded perspective view showing the internal structure of the antenna according to the first embodiment of the present invention.

FIGS. 1-6 show an antenna according to the first embodiment of the present invention. FIG. 1 shows the antenna on the transmission surface side, FIG. 2 shows the antenna on the non-transmission surface side, FIG. 3 shows a relay member used in the antenna, FIG. 4 shows the connection structure of a coil and the relay member, FIG. 5 shows the internal structure of the antenna, and FIG. 6 partially shows the cross section structure of the antenna.

The antenna 1 shown in FIGS. 1-6 comprises a coil 10 formed by a conductor wire such as an enameled wire, a flat-plate-shaped magnetic member 30 covering a first surface (non-transmission surface) of the coil 10, and a relay member 20 comprising internal terminal portions 21*a*, 21*b* connected to lead wires 11*a*, 11*b* of the coil 10. The coil 10 and the relay member 20 are disposed between a magnetic member assembly 31 and an adhesive layer assembly 32 described later, and made integral with the magnetic member 30 by adhesive layers 12*a*, 12*c*.

The coil 10 formed by a spirally wound conductor wire has a lead portion, in which a lead wire 11*a* extending from an inside end of the coil 10 and a lead wire 11*b* extending from an outside end of the coil 10 are positioned. Because the relay member 20 is disposed outside the coil 10 at a position close to the lead portion of the coil 10 as shown in FIG. 4, they do not overlap, suffering no thickness increase. Because the lead wires 11*a*, 11*b* of the coil 10 are connected to the internal terminal portions 21*a*, 21*b* through a circular notch 153 of the relay member 20, there is no interference between the lead wires 11*a*, 11*b* and the relay member 20, resulting in no problems such as disconnection, etc. Though the relay member 20 is in a rectangular plate shape in this embodiment, its shape is not restricted.

For example, when a flat coil of 4 turns is formed by winding a self-bonding enameled wire as shown in FIG. 4, there is a thick portion in which the inside lead wire 11*b* crosses a three-turn conductor wire. However, because the conductor wire is sufficiently thin, such thick portion does not have substantially no influence on the entire thickness of the antenna, so that it can easily follow the bending of the coil 10, etc.

The relay member 20 shown in FIG. 3 comprises a rectangular substrate 25 having a notch 153 through which the lead wires 11*a*, 11*b* of the coil 10 pass, and a pair of terminal members (conductor patterns) 26*a*, 26*b* formed on the substrate 25, the terminal members 26*a*, 26*b* extending in parallel between the opposing sides (internal side and external side). Each terminal member 26*a*, 26*b* comprises a an internal terminal portion 21*a*, 21*b* connected to an end of each lead wire 11*a*, 11*b* of the coil 10, an external terminal portion 22*a*, 22*b* connected to an external circuit such as a power supply circuit, etc., and a line portion 23*a*, 23*b* integrally connecting the internal terminal portion 21*a*, 21*b* to the external terminal portion 22*a*, 22*b*. Though both internal terminal portions 21*a*, 21*b* and external terminal portions 22*a*, 22*b* are exposed on the same main surface of the relay member 20, they may be exposed on different main surfaces.

The relay member 20 has a first region 20*a* overlapping the magnetic member 30, and a second region 20*b* extending from a periphery of the magnetic member 30. The relay member 20 is provided with the internal terminal portions 21*a*, 21*b* in the first region 20*a*, which does not overlap the coil 10, and the external terminal portions 22*a*, 22*b* connected to the internal terminal portions 21*a*, 21*b* via the line portions 23*a*, 23*b* in the second region 20*b*. The external terminal portions 22*a*, 22*b* are preferably exposed on the transmission surface side of the magnetic member 30.

Because the internal terminal portions 21*a*, 21*b* connected to the lead wires 11*a*, 11*b* of the coil 10 are covered with the magnetic member 30 or the adhesive layers 12*a*, 12*c*, the connecting portion of the lead wires 11*a*, 11*b* to the internal terminal portions 21*a*, 21*b* is protected, thereby avoiding the breakage of the lead wires 11*a*, 11*b*.

With a relay-member-integral coil 33 comprising the internal terminal portions 21*a*, 21*b* connected to the lead wires 11*a*, 11*b* of the coil 10 produced in advance, the antenna 1 can be easily connected to other circuits with the external terminal portions 22*a*, 22*b* in the projecting second region 20*b* of the relay member 20. The connection of the external terminal portions 22*a*, 22*b* can be achieved with a clamp metal connector, etc. in addition to soldering.

The relay member 20 has a positioning hole 152 used at the time of assembling the antenna, between the connecting lines 23*a*, 23*b*, and a pair of semi-circular notches 153, 153 on the periphery, though their positions and numbers may be changed if necessary. In other figures, the hole and notches may be omitted for simplicity.

Though the lead wires 11*a*, 11*b* may be soldered to the internal terminal portions 21*a*, 21*b*, they are preferably connected by heat press bonding, ultrasonic vibration welding, etc. In the heat press bonding, the ends of the lead wires 11*a*, 11*b* are pressed to the internal terminal portions 21*a*, 21*b* by a heated head for thermal diffusion bonding. In the ultrasonic vibration welding, the ends of the lead wires 11*a*, 11*b* are pressed to the internal terminal portions 21*a*, 21*b* by an ultrasonic vibration head for press bonding with vibration energy. Because such connecting methods do not increase the height of the internal terminal portions 21*a*, 21*b* covered with the magnetic member 30, the antenna is not made thicker. The coil 10 made integral with the relay member 20 by connecting the lead wires 11*a*, 11*b* to the internal terminal portions 21*a*, 21*b* is called relay-member-integral coil 33 below.

To prevent the breakage and cracking of the magnetic member 30, and to prevent the detachment of debris when the magnetic member 30 is broken, a resin film 15 is preferably attached as a protective layer to the non-transmission surface of the magnetic member 30 via an adhesive layer 12*b* as shown in FIG. 5. A peelable liner (polyester film) 16 is attached to a surface of the adhesive layer 12*c* for protection. The relay member 20 may be covered with another adhesive layer. The peelable liner 16 is removed when the antenna is attached to an object to be attached. The magnetic member 30 integral with the protective layer 15, etc. is called a magnetic member assembly 31, and the adhesive layer 12*c* integral with the peelable liner 16 is called an adhesive layer assembly 32.

The magnetic member 30 as large as sufficiently covering the entire coil 10 and part of the relay member 20 is disposed on the non-transmission side of the coil 10 via the adhesive layer 12*a*. If the distance in a plane direction between a periphery of the coil 10 and a periphery of the soft-magnetic member 30 were small, the positional displacement, etc. of the soft-magnetic member 30 would have large influence on a leaked magnetic flux, resulting in the unevenness of electric characteristics (inductance, Q value, resonance frequency, etc.) among the antennas, and thus the unevenness of communicable distance. Accordingly, the distance should be sufficiently large to avoid the unevenness of electric characteristics. Specifically, the distance is preferably 0.5 mm or more.

As shown in FIG. 5, the first adhesive layer 12*a* interposed between the magnetic member 30 and the relay-member-integral coil 33 comprising the coil 10 connected to the relay member 20 preferably has such thickness as to absorb a step between the coil 10 and the relay member 20. The relay-member-integral coil 33 is preferably covered with the second adhesive layer 12*c*. The second adhesive layer 12*c* protects the coil 10 and the relay member 20, and acts to fix the antenna 1 in a wireless communications apparatus.

It is preferable that any adhesive layer 12*a*, 12*b*, 12*c* has sufficient flexibility to follow the shape of an object to be attached, and is easily deformable by heat pressing. The use of a single- or double-sided acrylic adhesive tape for such adhesive layer makes handling easy.

Increase in the thickness of the adhesive layer 12*a* determining the lamination-direction distance between the coil 10 and the magnetic member 30 leads to decrease in magnetic flux passing through the magnetic member 30, resulting in a short communication distance. On the other hand, the adhesive layers 12*a*, 12*c* should absorb the thickness difference (step) of structural members laminated. Accordingly, the thickness of the adhesive layers 12*a*, 12*c* is preferably in a range of 10-100 μm.

When a brittle member such as a sintered ferrite plate, etc. is used for the magnetic member 30, it may be broken or cracked by handling. Accordingly, the attaching of the protective layer 15 to the magnetic member 30 in advance prevents not only the breakage, etc. of the magnetic member 30, but also the detaching of its debris by breakage, etc.

The protective layer 15 is preferably constituted by a flexible insulation film of polyethylene terephthalate (PET), etc. Taking into consideration the thickness of the antenna 1, the thickness of the protective layer 15 is preferably 150 μm or less. Because the magnetic member 30 is held by the adhesive layer 12*a* and the protective layer 15, its debris is not detached when broken. The protective layer 15 prevents the breakage from propagating, thereby preventing decrease in the effective permeability of the magnetic member 30, and thus suppressing the variation of the resonance frequency of the antenna.

Figure 6:
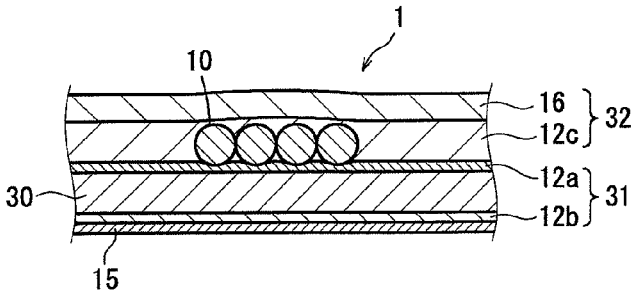
FIG. 6 is a partial cross-sectional view showing the internal structure of the antenna according to the first embodiment of the present invention.

FIG. 6 shows the details of a cross section of the antenna 1. In the depicted example, the adhesive layer 12*c* on the transmission side of the coil 10 is thicker than other adhesive layers 12*a*, 12*b*. Because the coil 10 and the relay member 20 are sandwiched by the thin adhesive layer 12*a* and the thick adhesive layer 12*c*, the coil 10 is close to the magnetic member 30, with a step by the coil 10 absorbed. A thicker adhesive layer 12*a* increases a gap between the coil 10 and the magnetic member 30, resulting in more leaked magnetic flux.

(2) Constituent Parts (a) Coil

The coil 10 is formed by spirally winding a conductor wire 2 turns or more, with lead wires 11*a*, 11*b* extending from its internal and external ends. Though the size of the coil 10 is determined by a space in which the antenna 1 is mounted, the coil 10 preferably has as large an area as possible. Though the conductor wire may be a single- or multi-wire, it is preferably a single-wire for a smaller height of the antenna 1. Specifically, the conductor wire is preferably an enameled single-wire, more preferably an enameled wire (self-bonding wire) with a fusible overcoat. The self-bonding wire makes integration with the coil 10 easy. The diameter of the single-wire is preferably 30-100 μm. When it is less than 30 μm, the conductor wire is easily broken in winding, and the coil 10 is easily deformed at the time of assembling, resulting in difficulty in handling.

The Q value is also deteriorated. On the other hand, when it is more than 100 μm, the antenna 1 is too thick. As a result, air is trapped when the coil 10 is attached to the magnetic member 30 with an adhesive layer, resulting in lower fixing strength of the coil 10.

(b) Relay Member

When the antenna 1 should be flexible, the relay member 20 is preferably a flexible printed circuit board comprising terminal members 26*a*, 26*b* formed on a polyimide film substrate 25. When flexibility is not needed, a rigid printed circuit board formed by a glass-fiber-reinforced epoxy resin may be used. Also, a rigid-flexible printed circuit board composed of a flexible printed circuit board and a rigid printed circuit board may be used.

The relay member 20 thinner than 30 μm does not have sufficient strength. On the other hand, when it is thicker than 200 μm, an overlapping portion of the relay member 20 and the lead wires 11*a*, 11*b* of the coil 10 is too thick, resulting in a step with other portions. Though a step per se does not affect the characteristics of the antenna 1, partial thickness increase fails to provide a flat transmission surface, likely hindering the arrangement (attachment) of the antenna 1, and making the entire antenna 1 thicker when the partial thickness is to be absorbed. Accordingly, the thickness of the relay member 20 is preferably 30-200 μm, more preferably 40-150 μm.

The relay member 20 can be formed on a flexible or rigid substrate by photolithography. Specifically, a metal foil is adhered to a surface of the substrate, coated with a photoresist, and then subject to patterning exposure; a photoresist layer in other portions than a predetermined pattern is removed; the exposed metal foil is removed by chemical etching to form a conductor pattern coated with the photoresist layer; and part of the photoresist layer is removed to partially expose the metal foil at both ends of the conductor pattern, so that terminal members (conductor patterns) 26*a*, 26*b*, whose internal terminal portions 21*a*, 21*b* and external terminal portions 22*a*, 22*b* are exposed, are formed.

(c) Magnetic Member

The magnetic member 30 need only be large enough to cover the coil 10 and the lead wires 11*a*, 11*b*. The thickness of the magnetic member 30 is preferably 50-300 μm, though it may vary depending on the magnetic properties such as permeability, etc. of a soft-magnetic material used.

Soft-magnetic materials for the magnetic member 30 include soft-magnetic ferrites such as Ni ferrite, Mn ferrite, Li ferrite, etc., and soft-magnetic alloys such as Fe—Si alloys, Fe- or Co-based amorphous alloys, ultra-fine crystalline, soft-magnetic alloys, etc. When the soft-magnetic ferrite is used as a magnetic material, green sheets formed by known sheeting technologies such as a doctor blade method are formed into a predetermined shape, and sintered with or without lamination. When laminated, green sheets of different soft-magnetic ferrites may be laminated such that constituting layers have different magnetic properties. When the amorphous alloy or the ultra-fine crystalline soft-magnetic alloy is used as a magnetic material, the alloy sheet usually in a ribbon shape is cut to a predetermined shape to obtain the magnetic member 30 with or without lamination. Also, the amorphous alloy or the ultra-fine crystalline soft-magnetic alloy may be formed into powder or flakes, dispersed in a resin or a rubber, and then formed into a sheet.

[2] Second Embodiment

Figure 7:
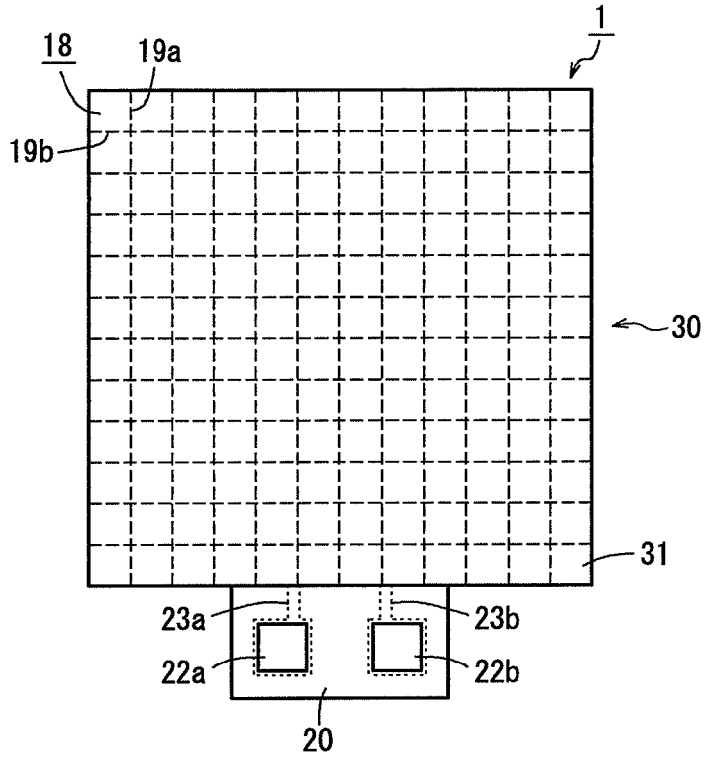
FIG. 7 is a bottom view showing an antenna according to the second embodiment of the present invention.

FIG. 7 shows an antenna according to the second embodiment of the present invention, which comprises a magnetic member 30 constituted by pluralities of separate pieces 18. Because this antenna is the same as the antenna in the first embodiment, except that the magnetic member 30 is divided, the explanations of common portions will be omitted, and only the magnetic member 30 will be explained in detail below.

Though the use of a rigid sintered ferrite plate as the magnetic member 30 provides an antenna 1 having no flexibility, the use of a magnetic member 30 constituted by pluralities of separate pieces 18 provides the antenna 1 with flexibility. When the amorphous alloy or the ultra-fine crystalline soft-magnetic alloy is used as the magnetic member 30, the division of the alloy sheets to pluralities of pieces 18 suppresses the generation of eddy current. Spaces between adjacent pieces act as magnetic gaps, and the expansion of gaps between pieces is prevented by the resin film 15, thereby avoiding decrease in permeability, and thus suppressing the variation of the resonance frequency of the antenna 1. In any case, because the antenna 1 is not always disposed on a flat surface but may be disposed on a curved surface, the flexibility of a magnetic member 30 constituted by pluralities of pieces 18 increases the degree of freedom of disposing the antenna 1. The pieces 18 are held at least by the adhesive layer 12*a*.

Though each piece 18 preferably has a rectangular shape of 1-5 mm in each side, it may have an irregular shape to prevent breakage and its propagation. Taking into consideration the formability of slits, etc., the piece 18 more preferably has a rectangular shape of 1-5 mm×5 mm.

To obtain the magnetic member 30 constituted by pluralities of separate pieces 18, (a) after the coil 10 is attached to the magnetic member 30 to constitute an antenna, the magnetic member 30 is divided along slits 19*a*, 19*b*, through-holes or recesses (not shown) formed on at least one main surface of the magnetic member 30; (b) when the magnetic member assembly 31 and the relay-member-integral coil 33 are formed in advance, the magnetic member 30 is divided before the relay-member-integral coil 33 is attached; or (c) pluralities of magnetic material pieces 18 formed in advance are disposed closely on the adhesive layer. To form a magnetic member 30 having slits, through-holes or recesses, the slits, through-holes or recesses are formed in each green sheet of a soft-magnetic material.

[3] Third Embodiment

Figure 8A:
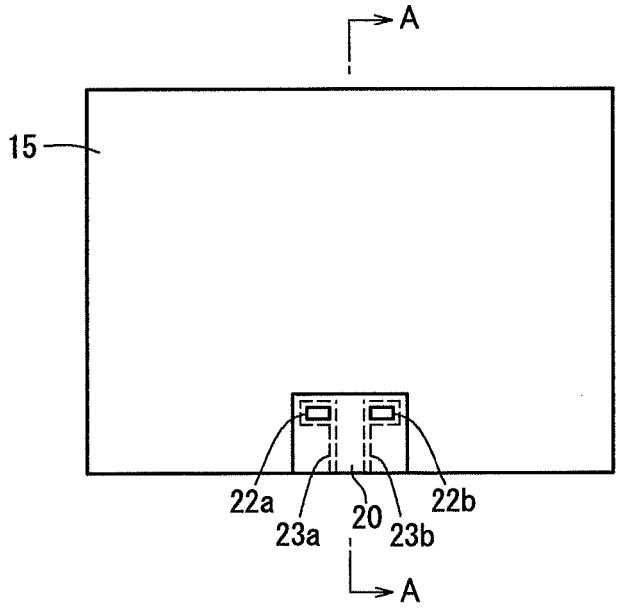
FIG. 8(*a*) is a bottom view showing an antenna according to the third embodiment of the present invention.
Figure 8B:
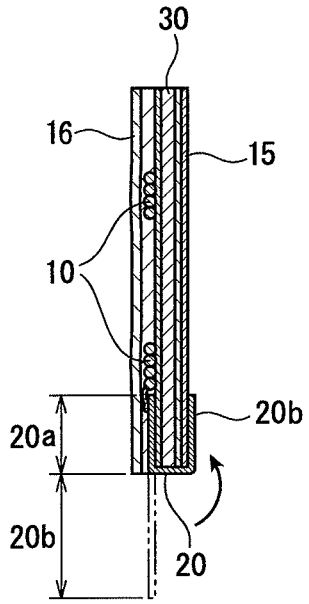

FIGS. 8(*a*) and 8(*b*) show an antenna according to the third embodiment of the present invention. Unlike the above-described structure in which the relay member 20 projects from the magnetic member 30, the second region 20*b* of the relay member 20 is bent onto the non-transmission surface of the magnetic member 30, and fixed by a double-sided adhesive tape, etc. in this embodiment. The external terminal portions 22*a*, 22*b* exposed on the transmission side of the coil 10 appear on the non-transmission surface side of the magnetic member 30, after the second region 20*b* of the relay member 20 is bent onto the non-transmission surface of the magnetic member 30. When the internal terminal portions 21*a*, 21*b* and the external terminal portions 22*a*, 22*b* are formed on different main surfaces of the relay member 20, the internal terminal portions 21*a*, 21*b* are also exposed on the non-transmission surface side of the magnetic member 30. This structure can reduce an area necessary for disposing the antenna.

[4]Fourth embodiment

Figure 9:
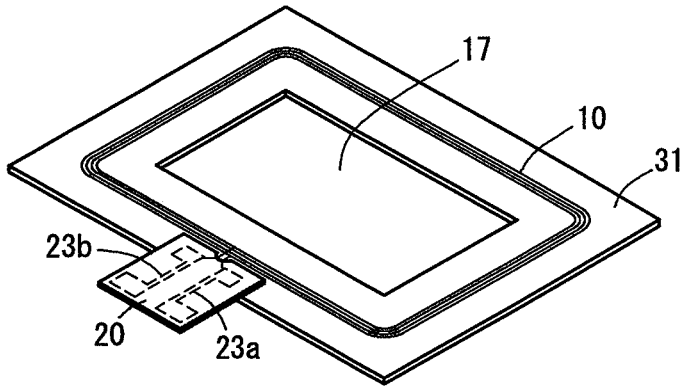
FIG. 9 is a perspective view showing an antenna according to the fourth embodiment of the present invention.

FIG. 9 shows an antenna according to the fourth embodiment of the present invention. In this antenna, the magnetic member 30, etc. are provided with an opening 17 inside the coil 10 to such an extent not to affect antenna characteristics largely. This structure makes it possible to attach the antenna 1 to an unflat surface easily, with a reduced weight of the antenna 1 by the opening 17. Further, when the antenna 1 is disposed near a battery, it can eliminate interference by the expansion of the battery.

[5] Fifth Embodiment

Figure 10:
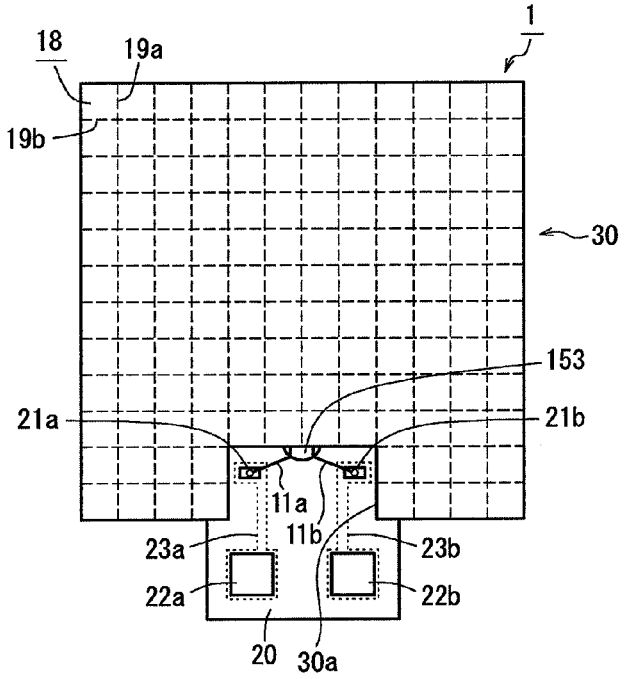
FIG. 10 is a bottom view showing an antenna according to the fifth embodiment of the present invention.

FIG. 10 shows an antenna according to the fifth embodiment of the present invention. In this antenna, part of the magnetic member 30 (region facing the internal terminal portions 21*a*, 21*b* of the relay member 20) is provided with a notch 30*a*. Though the internal terminal portions 21*a*, 21*b* and its vicinity, which overlap the lead wires 11*a*, 11*b*, tend to be locally thick, a hole or notch 30*a* provided in the magnetic member 30 can prevent such local thickening. Further, the connecting portions of the lead wires 11*a*, 11*b* of the coil 10 to the internal terminal portions 21*a*, 21*b* are protected by the surrounding hole or notch 30*a* of the magnetic member 30, preventing the breakage of the lead wires 11*a*, 11*b*.

[6] Sixth Embodiment

Figure 11:
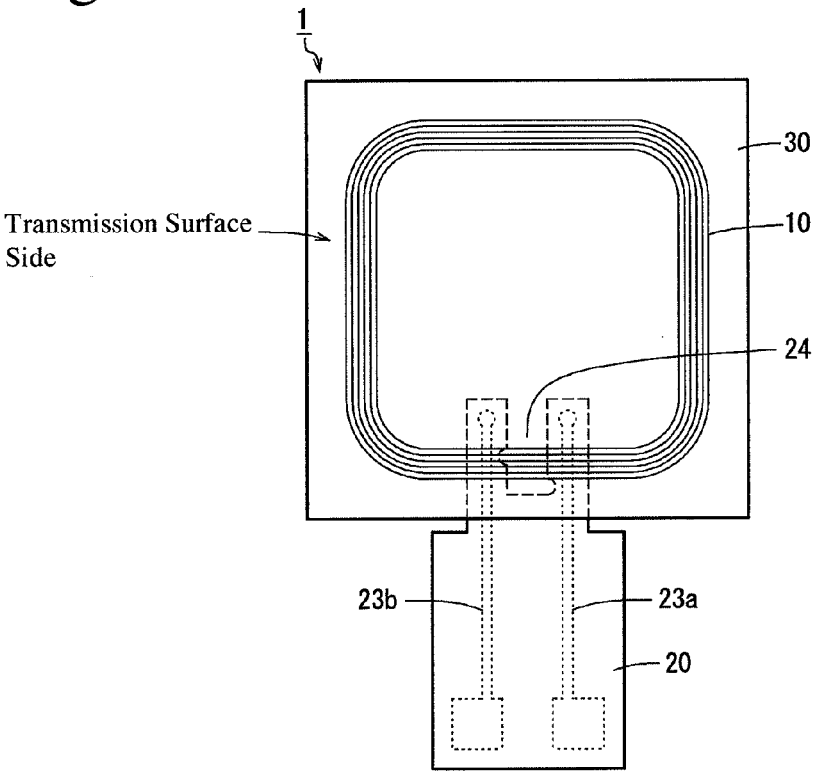
FIG. 11 is a plan view showing an antenna according to the sixth embodiment of the present invention.
Figure 12:
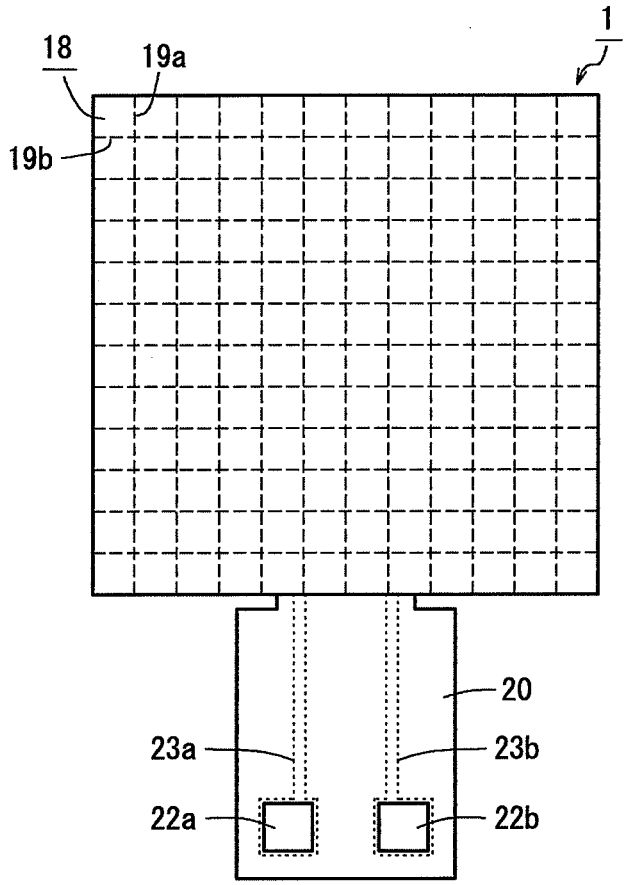
FIG. 12 is a bottom view showing an antenna according to the sixth embodiment of the present invention.
Figure 13:
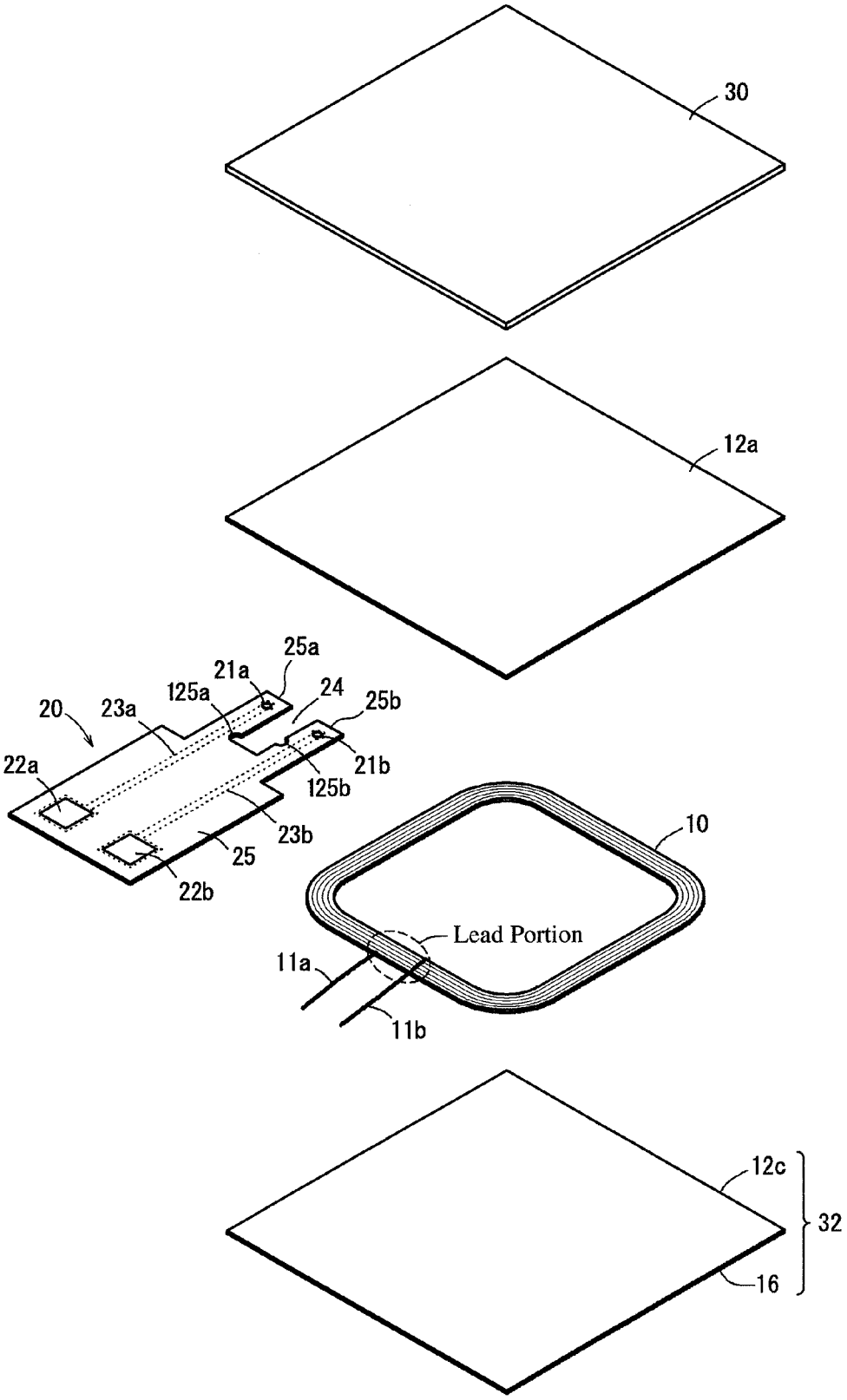
FIG. 13 is an exploded perspective view showing the internal structure of the antenna according to the sixth embodiment of the present invention.
Figure 14:
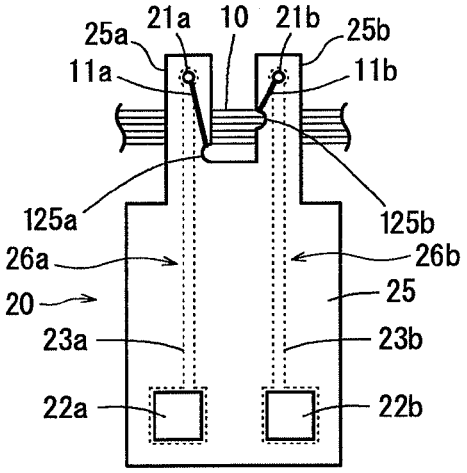
FIG. 14 is a plan view showing the connection structure of a coil to a relay member in the antenna according to the sixth embodiment of the present invention.

FIGS. 11-14 show an antenna according to the sixth embodiment of the present invention. FIG. 11 shows the antenna on the transmission surface side, FIG. 12 shows the antenna on the non-transmission surface side, FIG. 13 shows the internal structure of the antenna, and FIG. 14 shows the connection structure of a coil to a relay member. This antenna is characterized in the shape of the relay member, with its other portions basically the same as shown in FIG. 1, etc. Accordingly, the shape of the relay member will be mainly explained below.

A substrate 25 for the relay member 20 has a substantially rectangular, flat shape with a pair of projections 25*a*, 25*b* on one side. A pair of terminal members 26*a*, 26*b* longitudinally extend on the substrate 25, such that each internal terminal portion 21*a*, 21*b* is positioned in each projection 25*a*, 25*b*, while external terminal portions 22*a*, 22*b* are positioned near a side (external side) opposite to the projections 25*a*, 25*b*. The internal terminal portions 21*a*, 21*b* and the external terminal portions 22*a*, 22*b* are formed on the same surface of the substrate 25. Two notches 125*a*, 125*b* are provided in a slit-shaped notch 24 between a pair of projections 25*a*, 25*b*.

As shown in FIG. 14, the projections 25*a*, 25*b* of the substrate 25 overlap the coil 10, and the internal terminal portions 21*a*, 21*b* are located inside the coil 10. The lead wires 11*a*, 11*b* of the coil 10 extend on the projections 25*a*, 25*b* to be connected to the internal terminal portions 21*a*, 21*b* inside the coil 10. The notch 125*a* for the lead wire 11*a* is preferably located near an outer periphery of the coil 10 (near a root portion of the projection 25*a*), and the notch 125*b* for the lead wire 11*b* is preferably located near an inner periphery of the coil 10 (at a position slightly separate from the root portion of the projection 25*b*). With this structure, the positions of the lead wires 11*a*, 11*b* are fixed, and root portions of the lead wires 11*a*, 11*b* extending from the coil 10 are sandwiched by a pair of projections 25*a*, 25*b*, so that the lead wires 11*a*, 11*b* are not separated from the coil. Because the relay member 20 has a large adhesion area to the adhesive layers 12*a*, 12*c*, the detachment of the relay member 20 can be surely prevented. Because the projections 25*a*, 25*b* of the relay member 20 overlap part of the coil 10, the relay member 20 is preferably as thin as possible. Specifically, the thickness of the relay member 20 is preferably 100 μm or less.

[7] Seventh Embodiment

Figure 15A:
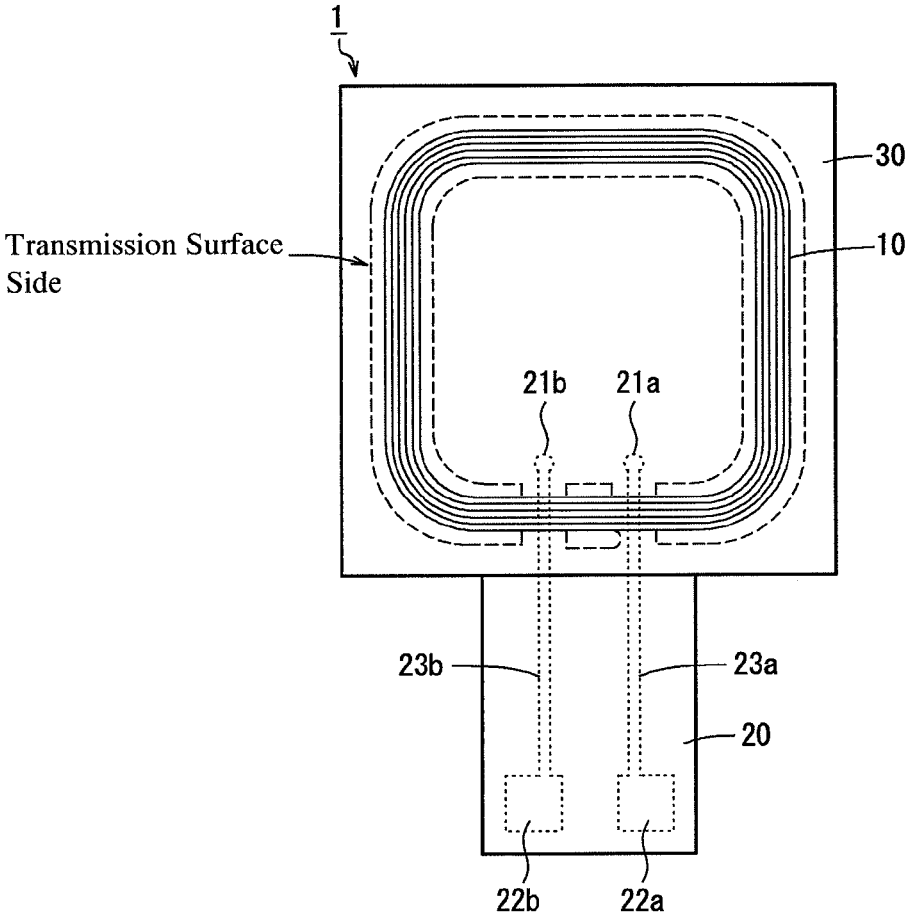
FIG. 15(*a*) is a bottom view showing an antenna according to the seventh embodiment of the present invention.
Figure 15B:
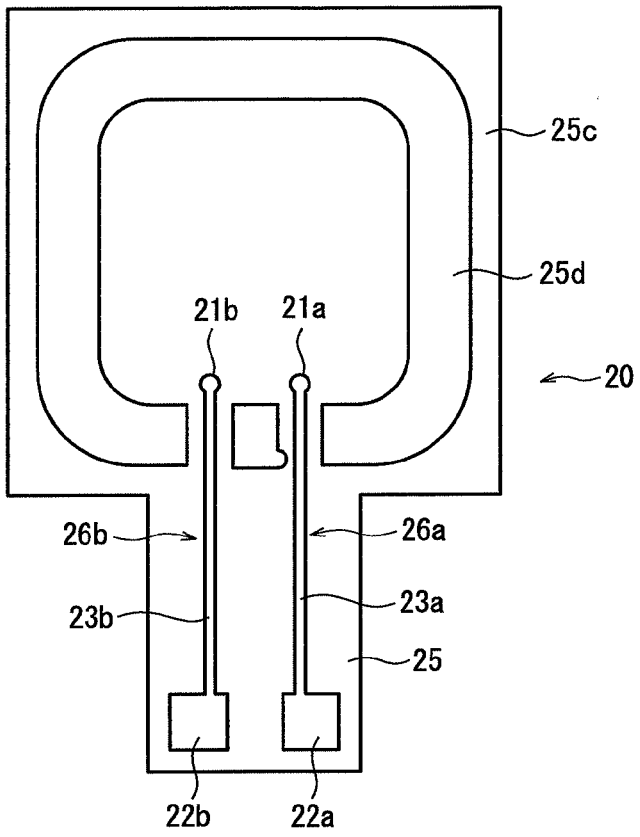

As shown in FIGS. 15(*a*) and 15(*b*), an extension 25*c* of the substrate 25 of the relay member 20 may exist on a substantially entire surface of the magnetic member 30 except for a portion having the coil 10. The extension 25*c* is provided with an annular hole 25*d* in a portion corresponding to the coil 10. This structure provides the relay member 20 with increased bonding strength with the adhesive layers 12*a*, 12*c*, and eliminates the problem of a step by the coil 10 overlapping the relay member 20.

In the first to seventh embodiments, (a) the internal terminal portions 21*a*, 21*b* connected to the lead wires 11*a*, 11*b* of the coil 10 are surrounded by the magnetic member assembly 31 and the adhesive layer assembly 32, or (b) even when the magnetic member 30 has a notch 30*a* as shown in FIG. 10, three sides are surrounded by the magnetic member assembly 31, and one main surface is held by the adhesive layer. Accordingly, deformation can be restricted, preventing the breakage of the conductor wire surely. When the notch 30*a* is filled with an insulating resin such as an epoxy adhesive, etc., deformation is further suppressed, ensuring the insulation of the internal terminal portions 21*a*, 21*b*.

[8] Wireless Communications Apparatus

Figure 16:
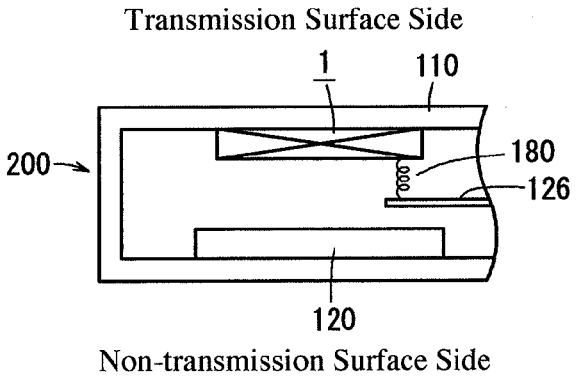
FIG. 16 is a partial cross-sectional view showing the internal structure of a mobile phone containing the antenna.
Figure 17:
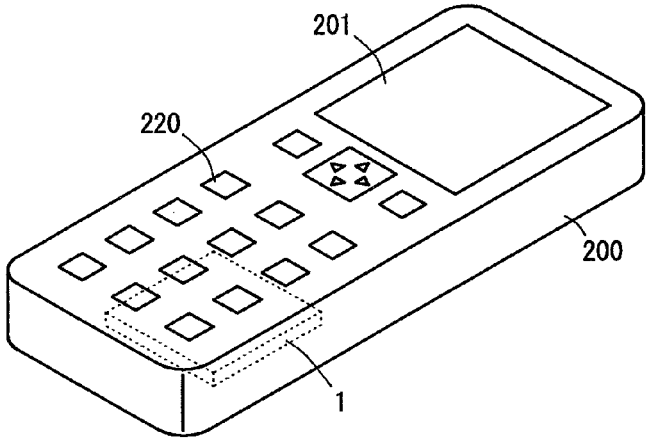
FIG. 17 is a perspective view showing a mobile phone containing the antenna.
Figure 18A:
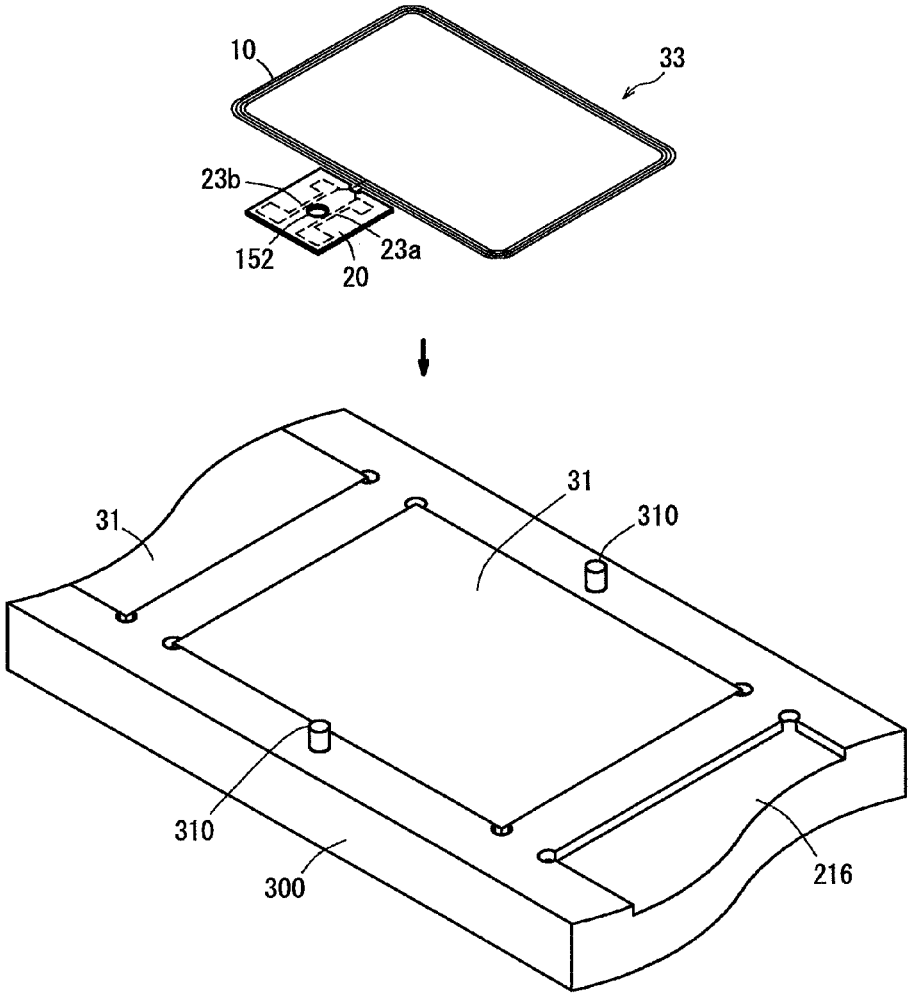
FIG. 18(*a*) is a perspective view showing the first step of assembling the antenna of the present invention.
Figure 18B:
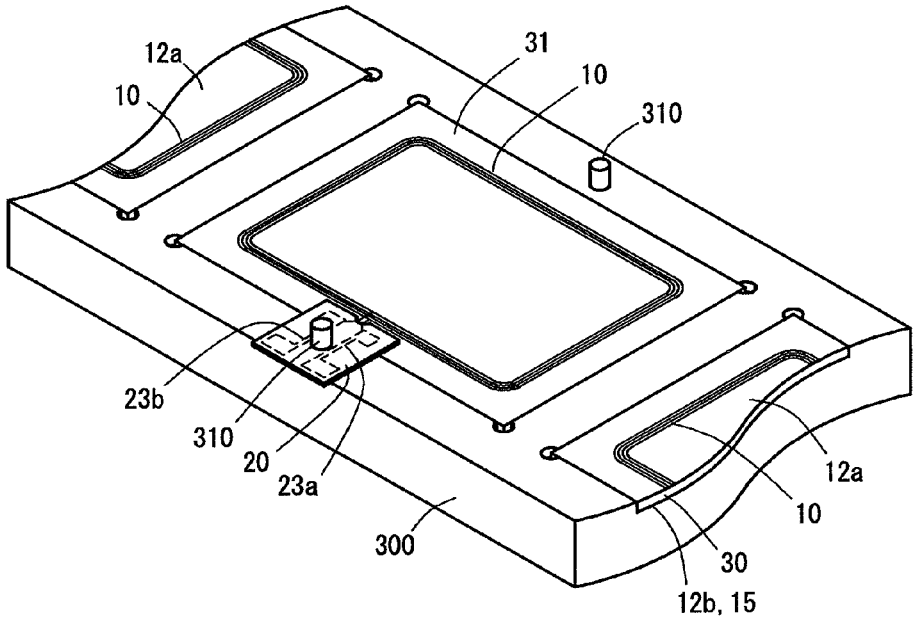
Figure 18C:
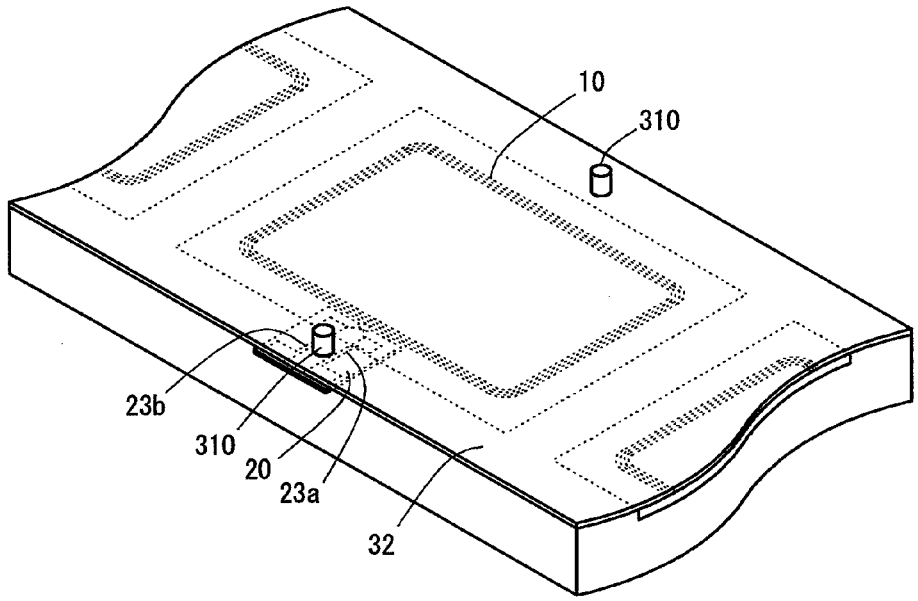
Figure 18D:
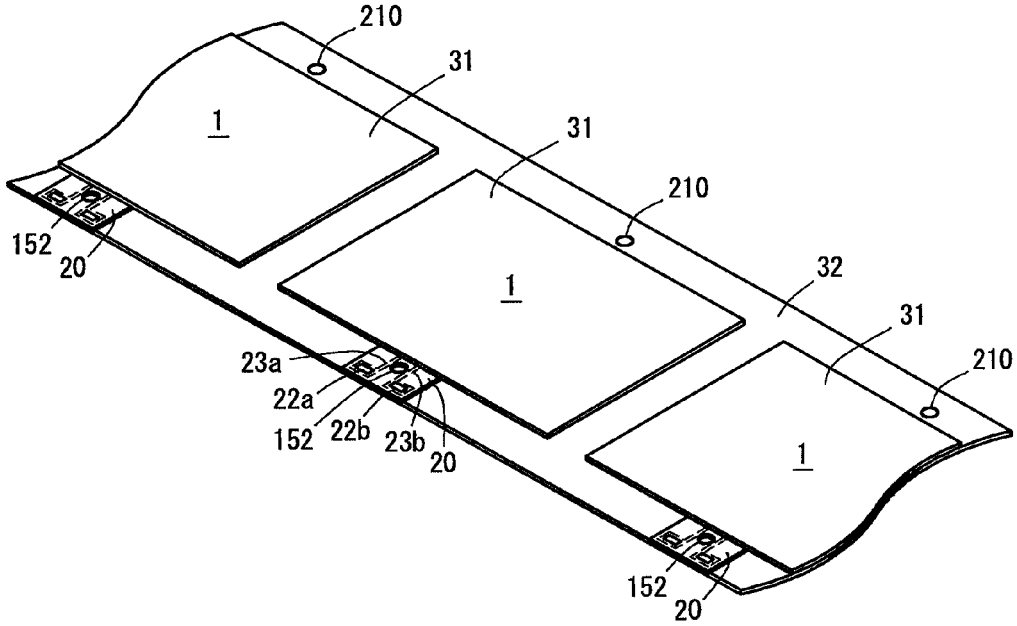

FIGS. 16 and 17 show a mobile phone as an example of wireless communications apparatuses comprising the antenna for near-field wireless communications. The mobile phone 200 comprises a synthetic resin case 110, a display means 201, a keypad 220, a wireless communications circuit board 126, a battery pack 120 such as a lithium ion battery, etc.

In the case 110, the antenna 1 opposes the circuit board 126 on the side of the magnetic member 30, and the case 110 on the side of the coil 10, so that electromagnetic coupling with other antennas is not hindered. In the example shown in FIG. 16, the antenna 1 is attached to the case 110 at a position immediately above the battery pack 120, such that the magnetic member 30 opposes the battery pack 120. Because the external terminal portions 22*a*, 22*b* are on the non-transmission surface side of the magnetic member 30 in the antenna 1, they are easily connectable to a power supply circuit, etc. on the circuit board 126, via a connecting means such as a connecting pin 180, etc.

The magnetic member 30 acts not only as a magnetic core but also as a magnetic yoke for the coil 10. Though a casing for the battery pack 120 is made of a metal such as aluminum, excellent antenna characteristics are kept even when the battery pack 120 is close to the antenna 1, because the magnetic member 30 prevents electromagnetic interference between the coil 10 and the metal casing of the battery pack 120.

[9] Assembling Method of Antenna

Referring to FIGS. 18(*a*)-18(*d*), the assembling of the antenna of the present invention having the basic structure shown in FIG. 5 will be explained in detail below. Used for the assembling of the antenna is an assembling jig 300 comprising pluralities of rectangular recesses 216 and pluralities of positioning pins 310 as shown in FIG. 18(*a*). Each recess 216 has such size and depth as to receive each magnetic member assembly 31. Each recess 216 is provided with positioning pins 310 on two opposing sides.

A magnetic member assembly 31 is received in each recess 216, with a protective layer 15 on the upper side and an adhesive layer 12*a* on the lower side. A surface of the adhesive layer 12*a* in the magnetic member assembly 31 received in each recess 216 is on the same level as or slightly higher than a surface of the assembling jig 300, on which the positioning pins 310 are provided.

A relay-member-integral coil 33 assembled in advance is attached to a surface of the adhesive layer 12*a*. A coil-winding jig (not shown) used for assembling the relay-member-integral coil 33 comprises a flange, a rectangular-cross-sectioned core projecting from a center of the flange, and a recess receiving the relay member 20. A conductor wire is wound around the rectangular-cross-sectioned core to form a rectangular coil 10, and end portions of the coil 10 are led to the recess of the flange, and cut to a predetermined length to form lead wires 11*a*, 11*b*. The relay member 20 is disposed in the recess with the internal terminal portions 21*a*, 21*b* on the upper side, and the lead wires 11*a*, 11*b* of the coil 10 are then fused to the internal terminal portions 21*a*, 21*b* to produce a relay-member-integral coil 33.

The coil-winding jig comprises positioning pores each corresponding to each positioning pin 310 of the assembling jig 300, and a pushing pin for removing the relay-member-integral coil 33. With the relay-member-integral coil 33 attached to the coil-winding jig opposing the magnetic member assembly 31, the positioning pins 310 of the assembling jig 300 are inserted into the positioning pores of the coil-winding jig, and the relay-member-integral coil 33 is pushed onto the adhesive layer 12*a* by the pushing pin of the coil-winding jig to attach the coil 10 and the relay member 20 to the adhesive layer 12*a*. Thereafter, the coil-winding jig is detached.

FIG. 18(*b*) shows a relay-member-integral coil 33 attached to the magnetic member assembly 31 received in each recess 216. One positioning pin 310 of the assembling jig 300 is inserted into the positioning hole 152 of the relay member 20. The coil 10 and its lead wires 11*a*, 11*b*, and a region of the relay member 20 in which the internal terminal portions 21*a*, 21*b* are formed, are attached to the magnetic member 30 by an adhesive layer 12*a*.

As shown in FIG. 18(*c*), the adhesive layer assembly 32 having positioning holes 210 are attached to the relay-member-integral coil 33 on the assembling jig 300, with the adhesive layer 12*c* on the lower side, such that the positioning pins 310 of the assembling jig 300 are inserted into the positioning holes 210 of the adhesive layer assembly 32. They are pressed at 100° C. for integration. By removing the assembling jig 300, an antenna assembly comprising pluralities of antennas 1 in line on a peelable liner ribbon 16 is obtained as shown in FIG. 18(*d*). The peelable liner 16 may be cut to obtain individual antennas 1.

The present invention will be explained in more detail referring to Examples below without intention of restricting the present invention thereto.

EXAMPLE 1

A self-bonding enameled wire of 80 μm in diameter was wound 4 turns to produce a rectangular, flat coil 10 of 35 mm in long side and 25 mm in short side. Used for the relay member 20 was a flexible polyimide film substrate of 100 μm in thickness and 10 mm×10 mm in outer size. Each adhesive layer was a double-sided acrylic adhesive tape, adhesive layers 12*a*, 12*b* being 30 μm in thickness, and an adhesive layer 12*c* being 100 μm in thickness. Used for the protective layer 15 was a PET film of 30 μm in thickness.

Used for the magnetic member 30 was a rectangular sintered ferrite plate having of 160 μm in thickness, 40 mm in long side and 30 mm in short side. The sintered ferrite plate had a composition (100% by mol in total) comprising 48.5% by mol of $Fe_2O_3$, 20% by mol of ZnO, 22.7% by mol of NiO, and 8.8% by mol of CuO, and initial permeability of 180.

Using these parts, the antenna shown in FIG. 1 was obtained. This antenna was 35.5 mm in a transverse length including the relay member 20, 40 mm in a longitudinal length, and 0.5 mm in maximum thickness (excluding a peelable liner), having self-inductance of 2.9 pH.

EXAMPLE 2

An antenna having the basic structure shown in FIG. 13 was produced by the following procedures. First, a 100-μm-thick adhesive layer 12*c* having a square shape of 22 mm in each side, both surfaces of which were provided with peelable liners 16, 16, was fixed to a jig having a flat surface. After a peelable liner 16 on the front surface was removed, a square flat coil 10 of about 19 mm in each side, which was formed by winding a self-bonding enameled wire of 80 μm in diameter 8 turns, was pressed onto the adhesive layer 12*c* for adhesion.

After a 70-μm-thick relay member 20 comprising a flexible polyimide substrate was laminated on the coil 10, a region of the relay member 20 including projections 25*a*, 25*b* was attached to the adhesive layer 12*c*. The lead wires 11*a*, 11*b* of the coil 10 were drawn from a slit-shaped notch 24 of the relay member 20, and their end portions were soldered to the internal terminal portions 21*a*, 21*b* of the relay member 20.

A square-shaped magnetic member assembly 31 of 22 mm in each side, which comprised a 200-μm-thick magnetic member 30 (sintered ferrite plate having the same composition as in Example 1), and a 100-μm-thick adhesive layer 12*a*, were overlapped and attached to the relay member 20 and the coil 10 under pressure. The magnetic member 30 had a notch 30*a* at a position corresponding to the internal terminal portions 21*a*, 21*b* of the relay member 20. The resultant antenna 1 was 33 mm in longitudinal length including the relay member 20, 22 mm in transverse length, and 0.7 mm in maximum thickness (excluding a parting paper), having self-inductance of 2.3 μH.

Figure 19:
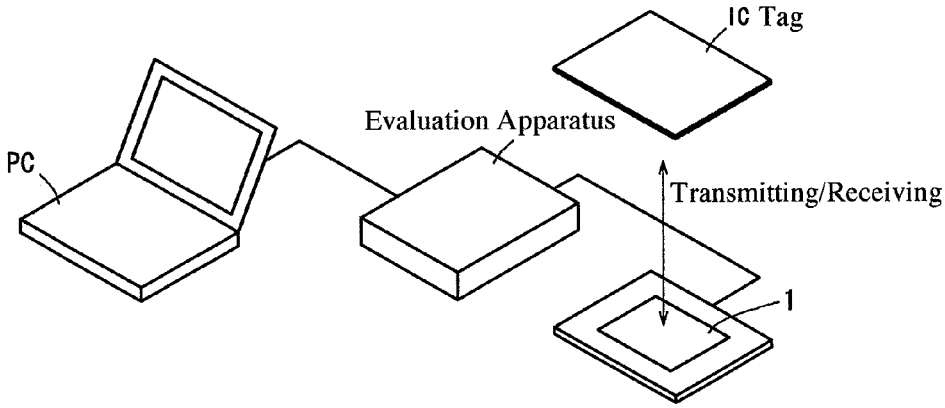
FIG. 19 is a schematic view showing an evaluation method of the communication distance of an antenna.
Figure 20:
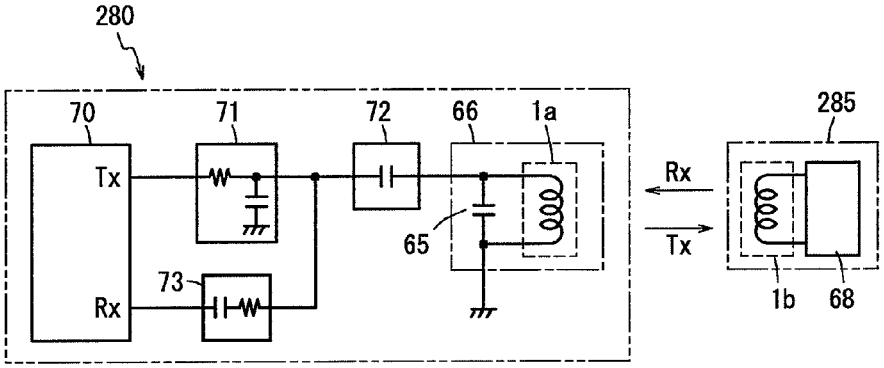
FIG. 20 is a block diagram showing the circuit structure of an antenna apparatus.
Figure 21:
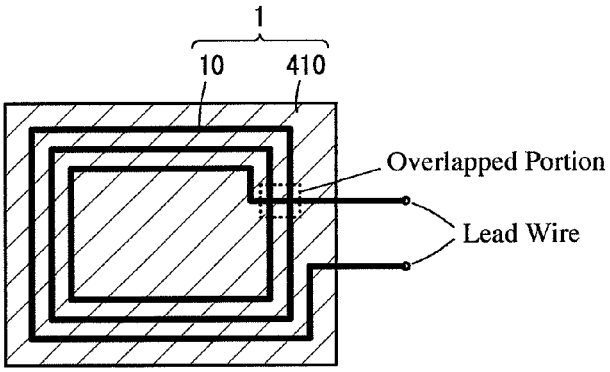
FIG. 21 is a plan view showing an example of conventional antennas.
Figure 22A:
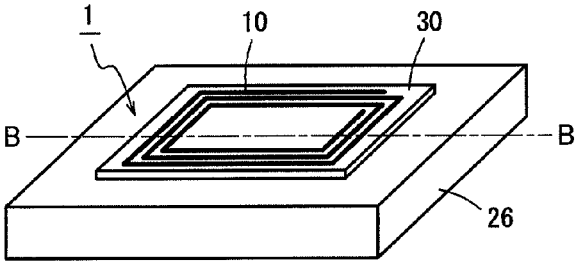
FIG. 22(*a*) is a perspective view showing another example of conventional antennas.
Figure 22B:
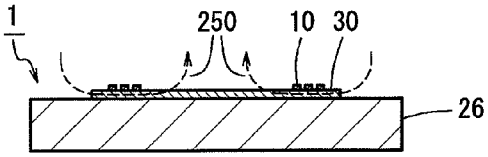

Communications between the antenna and an IC tag were conducted with an evaluation system shown in FIG. 19. Used as an evaluation apparatus was a reader/writer module TR3-202 available from Takaya Corporation, which comprised signal-treating circuit necessary for noncontact data communications, an information-stored IC chip, etc. The maximum distance of communications between the antenna and the IC tag was 57 mm in Example 1, and 43 mm in Example 2, both practically sufficient communication distances.

EFFECTS OF THE INVENTION

The use of a coil formed by a conductor wire such as an enameled wire, and a relay member having internal terminal portions and external terminal portions without overlapping the coil, with lead wires of the coil connected to the internal terminal portions, provides an antenna for near-field wireless communications, which has low height without too thick connecting portions to the lead wires, and is easily connectable to other circuits. Because the coil and part of the relay member disposed on the magnetic member are fixed to the first adhesive layer, and because the internal terminal portions are positioned in a region overlapping the magnetic member, or in a region surrounded by a hole or notch of the magnetic member, the connecting portions of the lead wires to the relay member are so protected that the lead wires are not easily broken. Further, the division of the magnetic member to pluralities of pieces provides a flexible antenna capable of easily following a curved surface.

What is claimed is:

1. An antenna comprising a coreless coil formed by winding a conductor wire, a relay member connected to said coil, and a magnetic plate member covering said coil and part of said relay member;

said relay member comprising a substrate having a notch, the substrate being disposed on a side of said coil, through which lead wires of said coil pass, and a pair of terminal members formed on said substrate, each terminal member comprising an internal terminal portion connected to an end of each lead wire, an external terminal portion connected to an external circuit, and a line portion connecting said internal terminal portion to said external terminal portion, said substrate having a smaller area footprint than an area footprint of said coil;

said coil and part of said relay member disposed on said magnetic member being fixed to a first adhesive layer on a non-transmission side of said coil; and said internal terminal portions being positioned in a region overlapping said magnetic member, or in a region surrounded by a hole or notch of said magnetic member.

2. The antenna according to claim 1, wherein said relay member comprises a first region overlapping said magnetic member, and a second region extending from an outer periphery of said magnetic member; and wherein said external terminal portions in said second region appear on a non-transmission surface side of said magnetic member.

3. The antenna according to claim 1, wherein said second region of said relay member is bent to the magnetic member side, so that said external terminal portions appear on a non-transmission surface side of said magnetic member.

4. The antenna according to claim 1, wherein both of said coil and said relay member are covered with a second adhesive layer provided on a transmission side of said coil.

5. The antenna according to claim 1, wherein a protective layer of a resin film is attached to a non-transmission surface side of said magnetic member.

6. The antenna according to claim 1, wherein said relay member extends to an inner periphery of said coil.

7. The antenna according to claim 1, wherein said magnetic member is constituted by pluralities of pieces attached to the first adhesive layer for flexibility.

8. The antenna according to claim 7, wherein pluralities of said pieces are formed by dividing said magnetic member along its slits, through-holes or recesses.

9. The antenna according to claim 1, wherein the notch of the substrate is arcuate and on an outer surface of the substrate.

10. The antenna according to claim 1, wherein the notch of the substrate is on an outer surface of the substrate closest to said coil.

* * * * *